US006316870B1

(12) United States Patent
Hendriks et al.

(10) Patent No.: US 6,316,870 B1
(45) Date of Patent: Nov. 13, 2001

(54) COLOR DISPLAY TUBE WITH IMPROVED SUSPENSION OF THE COLOR SELECTION ELECTRODE

(75) Inventors: Arnoldus Antonius Maria Hendriks; Wilhelmus Marinus Maria Van De Steen; Jean Winters; Piet Christiaan Jozef Van Rens, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/722,811

(22) Filed: Nov. 27, 2000

(30) Foreign Application Priority Data

Nov. 26, 1999 (EP) ..... 99203976

(51) Int. Cl.[7] ..... H01J 29/80
(52) U.S. Cl. ..... 313/407; 313/402
(58) Field of Search ..... 313/402, 406, 313/407

(56) References Cited

U.S. PATENT DOCUMENTS 5,003,218 3/1991 Gijrath et al. ..... 316/406
5,982,085 11/1999 Lakshmanan et al. ..... 313/407

FOREIGN PATENT DOCUMENTS 8800424 4/1988 (NL) ..... H01J/29/02

*Primary Examiner*—Vip Patel
(74) *Attorney, Agent, or Firm*—Aaron Waxler

(57) ABSTRACT

A color display tube (1) is disclosed with an improved suspension of the color selection electrode (12). In order to have a color display tube (1) with good properties of, for instance, color purity, it is of eminent importance that the positional stability of the color selection electrode (12) is excellent. Especially wide-screen tubes seem to be more sensitive to shocks by which the color selection electrode (12) may shift and cause discolorations. The positional stability of the color selection electrode (12) can be improved by increasing the stiffness of the corner sections (16) of the color selection electrode (12). This can be realized by introducing an additional support plate (41) in the corner section (16). Also the optimization of the position of the supporting element (17) with respect to this corner section (16) yields an improvement.

11 Claims, 8 Drawing Sheets

COLOR DISPLAY TUBE WITH IMPROVED SUSPENSION OF THE COLOR SELECTION ELECTRODE

BACKGROUND OF THE INVENTION

The invention relates to a color display tube comprising a display window with a circumferential upright edge and corner areas, a color selection electrode having a frame comprising corner sections having a rigid portion, which color selection electrode is suspended from supporting elements secured to the corner areas, with suspension means coupled to the corner sections.

The invention also relates to a corner section for use in a color selection electrode of a color display tube, having a rigid portion and suspension means, and to a color selection electrode provided with such a corner section.

SUMMARY OF THE INVENTION

A color display tube as described in the opening paragraph is disclosed in U.S. Pat. No. 5,003,218. The color display tube according to this specification is provided with a color selection electrode having a frame consisting of four diaphragm parts and four corner sections, suspended in the corners of the display window.

The color display tube described in U.S. Pat. No. 5,003,218 is provided with a color selection electrode to ensure that electron beams coming from three electron guns, mounted in a neck portion of the tube, only excite one color of electroluminescent material on the inner side of the display window. This color selection is achieved by applying, for instance, a shadow mask in the tube. This mask has a large number of apertures, generally arranged in either a slotted or a dotted pattern. If the color selection electrode is not positioned in the color display tube in a stable manner, small deviations of its position will lead to a deterioration of the picture quality. When the color selection electrode is shifted slightly, the shadowing effect of the color selection electrode changes and, consequently, the electron beams do not hit the appropriate electroluminescent material on the display window. This misregistration causes a lack of the corresponding color, or even worse, the wrong color of electroluminescent material is excited. These misregistrations cause discoloration of the display tube, leading to a deterioration of the quality of the picture on the color display tube. In practice, color display tubes provided with the suspension system as described in U.S. Pat. No. 5,003,218 show discolorations that are too large to fulfil the ever-increasing demand for picture quality. Especially wide-screen tubes and tubes with a real flat or almost flat outer surface of the display window suffer from these problems. It is a disadvantage of the known color display tube that it shows too large misregistrations.

It is an object of the invention to provide a color display tube having a color selection electrode with an improved suspension system as compared with the type described in the opening paragraph, which minimizes the registration errors on the display window.

According to the present invention, this object is realized with a color display tube which is characterized in that each rigid portion is provided with a part, fixed onto the rigid portion, increasing the stiffness of the corner section.

The invention is based on the recognition that the registration errors are minimized when the position accuracy of the color selection electrode with respect to the display window is improved. This is realized when the stiffness of the suspension system of the color selection electrode is increased. In that case, fewer deformations of the color selection electrode occur during the manufacturing process. Also in the final product, the color selection electrode is positioned much more accurately.

A second source of misregistrations is shifts of the color selection electrode that may occur in the color display tube after it has been manufactured. These shifts are caused by heavy shocks to which the color display tube is exposed, for instance, during transportation. For this situation as well, a larger stiffness of the suspension system leads to a larger positional stability of the color selection electrode.

This larger stiffness can be realized by adding a part to the rigid portion and fixing it thereon. Here, fixing is understood to cover all kinds of firm, not necessarily permanent connections by means of, for example, welding, gluing, screwing.

A preferred embodiment of the color display tube according to the present invention is characterized in that the rigid portion comprises a main plate and an oblique surface, and the part for increasing the stiffness comprises an additional support plate interconnecting the main plate and the oblique surface.

This additional support plate decreases the amount of bend in the suspension element. This leads to a more rigid connection between the color selection electrode and the support element in the corner area of the glass panel. In this construction, the mask position accuracy is improved and so is the picture quality.

A second preferred embodiment is characterized in that the stiffness is further increased by having free end portions of the supporting elements substantially located in a plane which coincides with the main plates of the rigid portions of the corner sections.

This measure increases the position accuracy of the color selection electrode with respect to the display window, because a possible shift of the color selection electrode can now only occur in the plane of the main plate of the corner sections which practically coincides with the plane of the supporting elements. Due to this construction, there is no, or practically no, momentum between the free ends of the supporting elements and the main plate of the rigid portion. This makes the color selection system very robust against, for instance, shocks, because it can hardly rotate around the supporting element.

A further embodiment is characterized in that the rigid portions of the corner sections are provided with an upright edge. The stiffness of the corner section can be further increased by this measure. For example, an upright edge can be realized by folding the edges of the main plate.

A still further embodiment is characterized in that the stiffness is further increased by having free end portions of the supporting elements substantially located in a plane which coincides with an upright edge of the rigid portions of the corner sections. In this situation, the torsion between the suspension element is diminished and the positional accuracy is improved.

The invention also relates to the corner sections of a color selection electrode and to a color selection electrode provided with such corner sections.

These and other aspects of the invention are apparent from and will be elucidated by way of non-limitative examples with reference to the drawings and the embodiments described hereinafter.

DESCRIPTION OF THE PREFERRED EMBODIMENTS

Figure 1:
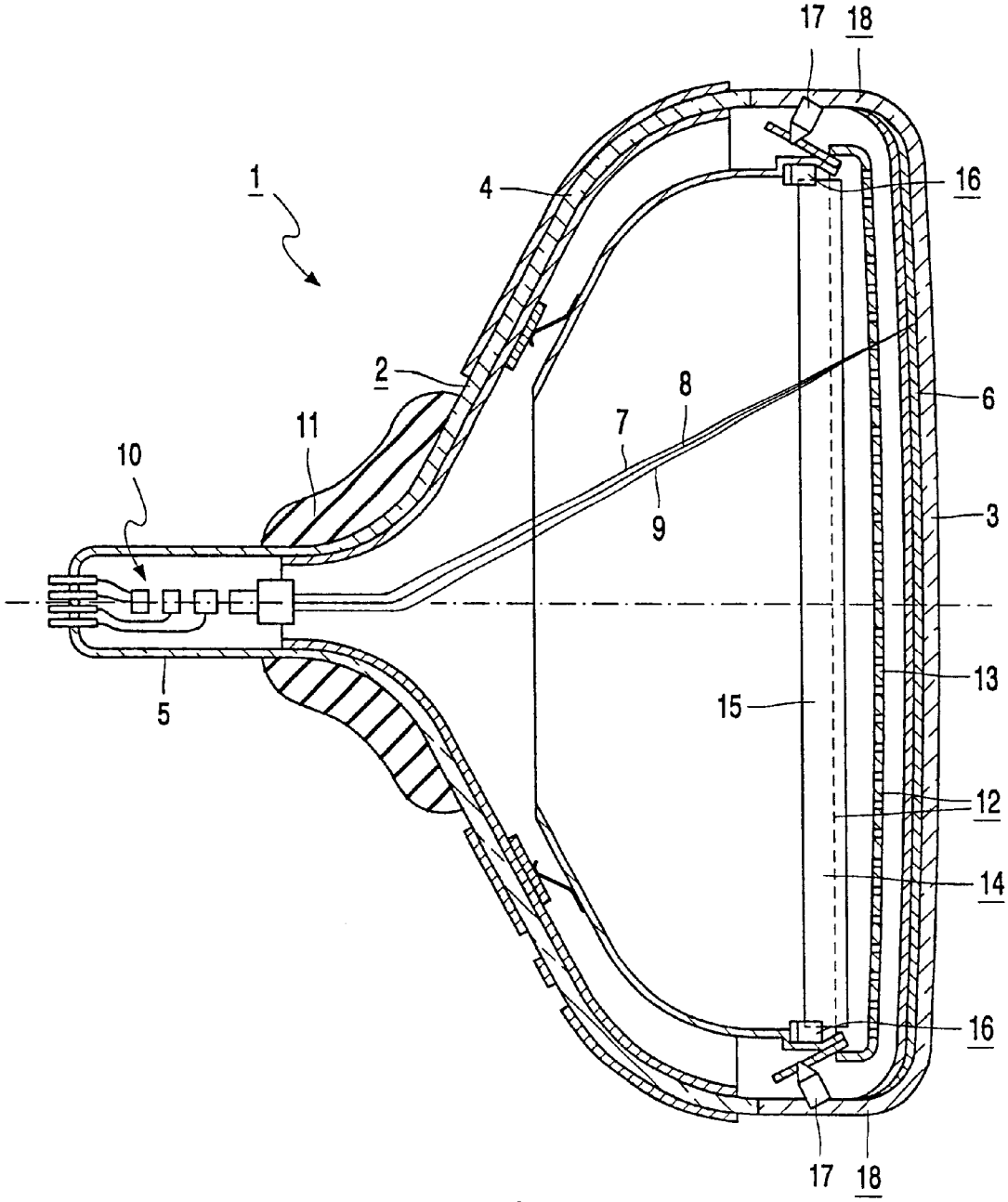
FIG. 1 is a sectional view of a color display tube according to the invention.

The color display tube 1 shown in FIG. 1 comprises an evacuated glass envelope 2 with a display window 3, a funnel-shaped part 4 and a neck 5. A screen 6 having a pattern of, for example, lines or dots of phosphors luminescing in different colors (e.g. red, green and blue) may be arranged on the inner side of the display window 3. The phosphor pattern is excited by the three electron beams 7, 8 and 9 that are generated by the electron gun 10. On their way to the screen, the electron beams 7, 8 and 9 are deflected by the deflection unit 11 ensuring that the electron beams 7, 8 and 9 systematically scan the screen 6. Before the electrons hit the screen 6, they pass through a color selection electrode 12. This color selection electrode 12 comprises a shadow mask 13, which is the real color-selective part: it intersects the electron beams so that the electrons only hit the phosphor of the appropriate color. The mask 13 may be an apertured mask having circular or elongate apertures, or a wire mask-.The color selection electrode 12 also comprises the frame 14 for supporting the mask. Parts that can be distinguished in the frame 14 are, amongst others, the corner sections 16 and the diaphragm parts 15, interconnecting the corner sections 16. The color selection electrode 12 is suspended from the display window 3 by using supporting elements 17, which are secured in the upright edge of the corner areas 18 of the display window 3. This way of suspending the color selection electrode 12 in a color display tube 1 will further be referred to as corner suspension.

Figure 2:
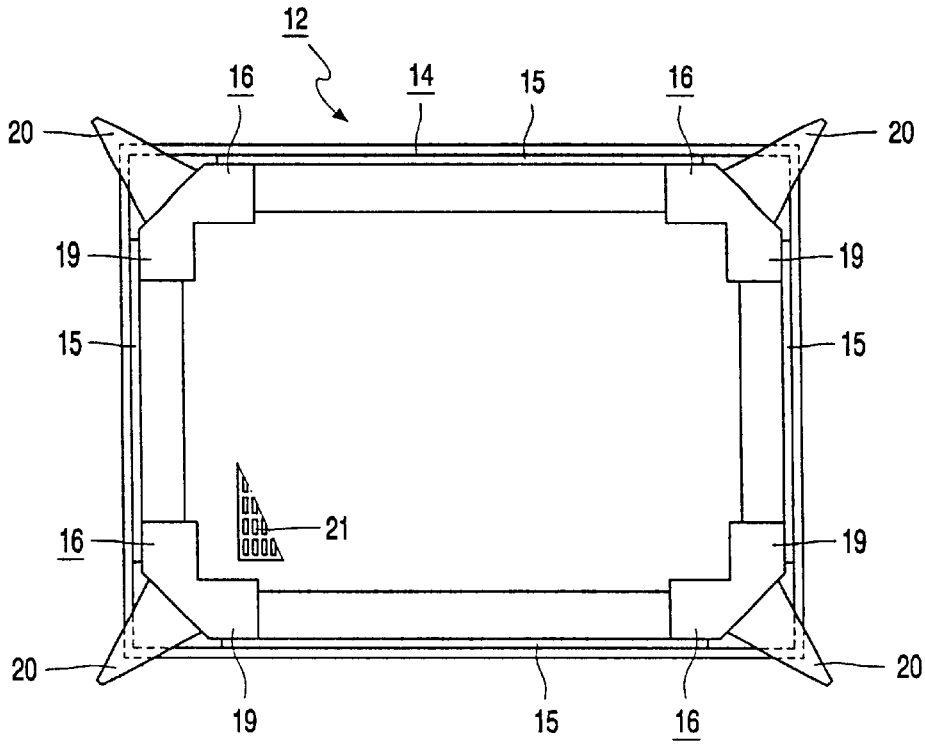
FIG. 2 is an elevational view of a color selection electrode to be mounted in the tube of FIG. 1.

FIG. 2 is an elevational view of a color selection electrode 12. The corner sections 16 in this Figure comprise two major portions, a rigid portion 19 for interconnecting the diaphragm parts 15 and a suspension element 20 for suspending the color selection electrode 12 from the display window 3. The mask 13 may be fixed to the diaphragm parts 15. The section 21 of the mask indicated in FIG. 2 is only meant as an example. During the manufacturing process, the color selection electrode 12 has to be inserted into and extracted from the display window 3 several times, amongst others for the processes of depositing the matrix and phosphor layers. In order to fulfil the demands regarding the required accuracy of the matrix and phosphor patterns, it is necessary that the position of the color selection electrode 12 can be reproduced very accurately when it is inserted again. This requires a high positional stability of the color selection electrode 12 in the color display tube 1.

Another aspect in current color display tubes, which is becoming more and more important, is the positional stability of the color selection electrode 12, which may be effected by transportation or shocks especially in east/west direction. East/west is commonly used for the direction in the plane of the three electron beams 7, 8 and 9. Normally, this is the horizontal direction. In particular, wide-screen color display tubes, having an aspect ratio or more than 4:3, preferably 16:9, suffer from a great sensitivity to these shocks. Displacements of the color selection electrode 12 up to a 100 $\mu$m may occur, which will cause severe problems with the color purity of the tube 1. This displacement effect is often referred to as 'swing effect'.

Figure 3:
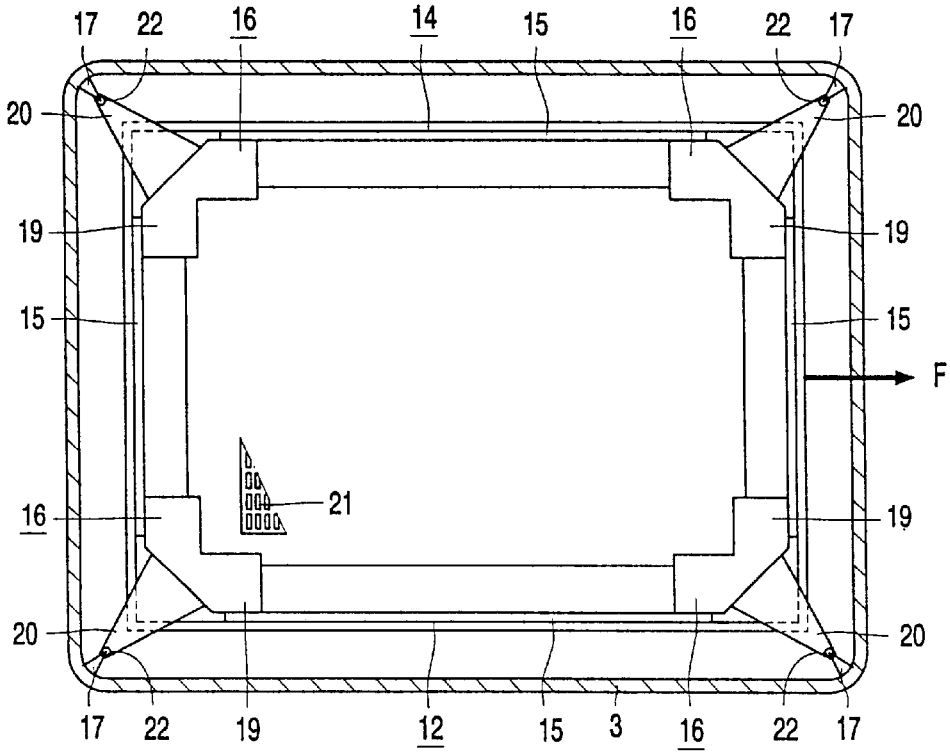
FIG. 3 is an elevational view of a color selection electrode mounted in a display window indicating the displacement measurement.
Figure 4:
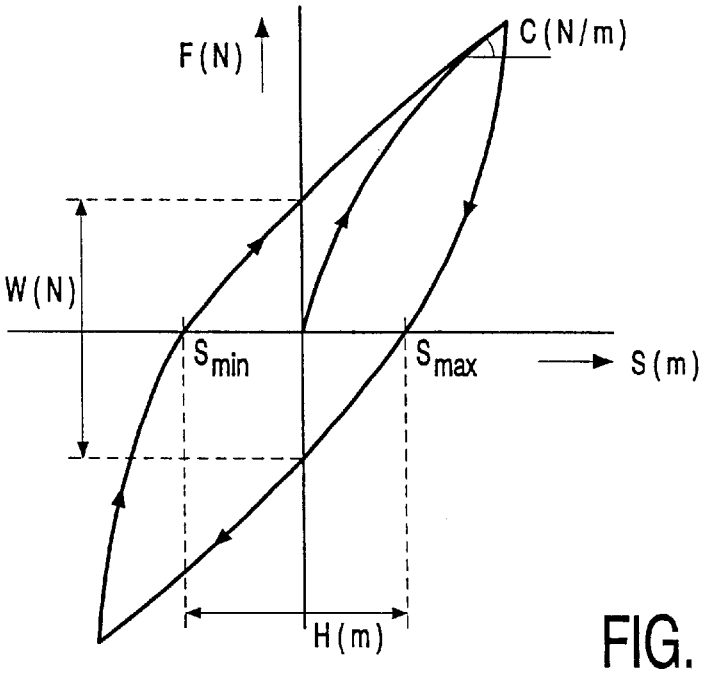
FIG. 4 is a graph indicating the hysteresis behavior of the color selection electrode.

This swing effect of the color selection electrode 12 can be explained in terms of a hysteresis diagram. This diagram can be constructed by a measurement as schematically shown in FIG. 3. The color selection electrode 12 is placed in a display window 3 and suspended on the supporting elements 17. Starting from a neutral situation, a force F is applied in the east/west direction on the color selection electrode 12. For a range of forces—from zero to a certain maximum, then back to zero, to a certain minimum and back to zero—applied the resulting displacement S of the color selection electrode is measured. The results of this measurement are shown in FIG. 4. This Figure demonstrates that a certain displacement remains when the force has been reduced back to zero. This is the so-called hysteresis effect. The consequence of this hysteresis is, that if a tube has been exposed to some external force—and this force is reduced to zero—a displacement of the color selection electrode 12 that may be in the total range between $S_{min}$ and $S_{max}$ may remain afterwards. This total range is now called the total hysteresis H (in m), being the total positional inaccuracy of the color selection electrode 12. Within this range, the system has no sufficient internal force to bring the color selection electrode 12 back to its neutral position. This total hysteresis H depends on two factors, namely the friction W of the suspension element 20 on the supporting element 17 and the stiffness C of the color selection electrode 12. The friction W (in N) is defined as the force range if the displacement is zero; the stiffness C (in N/m) is the inclination of the hysteresis curve for large forces (see FIG. 3). The relation between the hysteresis H, the friction F and the stiffness C can be approximated by:

$$H \approx \frac{W}{C}$$

This formula clearly shows seen that the positional accuracy of the color selection electrode can be improved—that is to say, the hysteresis should be made smaller—by increasing the stiffness or by decreasing the friction of the system.

In this disclosure, the measures to increase the stiffness of the color selection electrode (12) are discussed for a color selection electrode (12), the friction of which has already been optimized.

Figure 5:
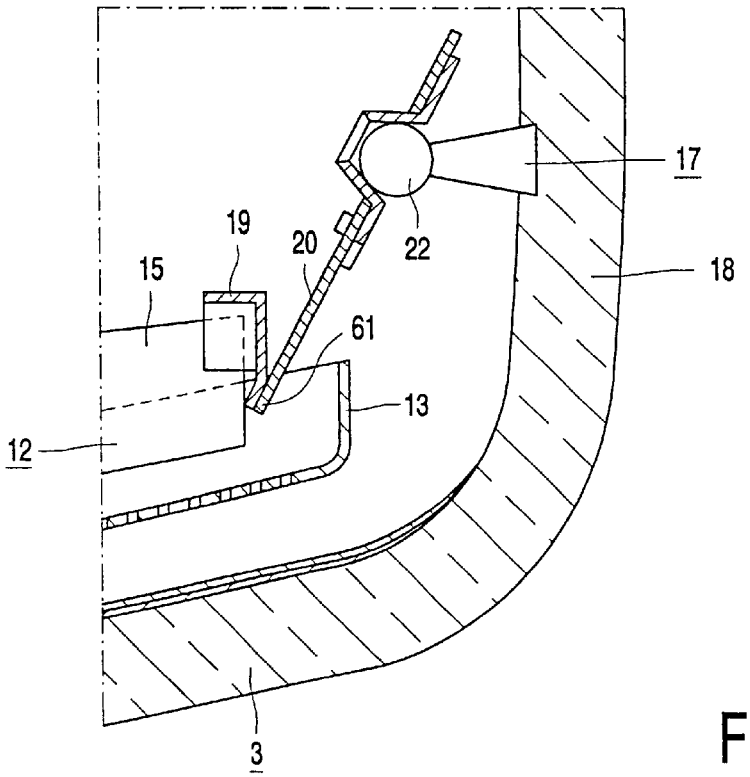
FIG. 5 is a sectional view of a portion of a tube like that of FIG. 1, showing the prior art suspension of a color selection electrode.
Figure 6:
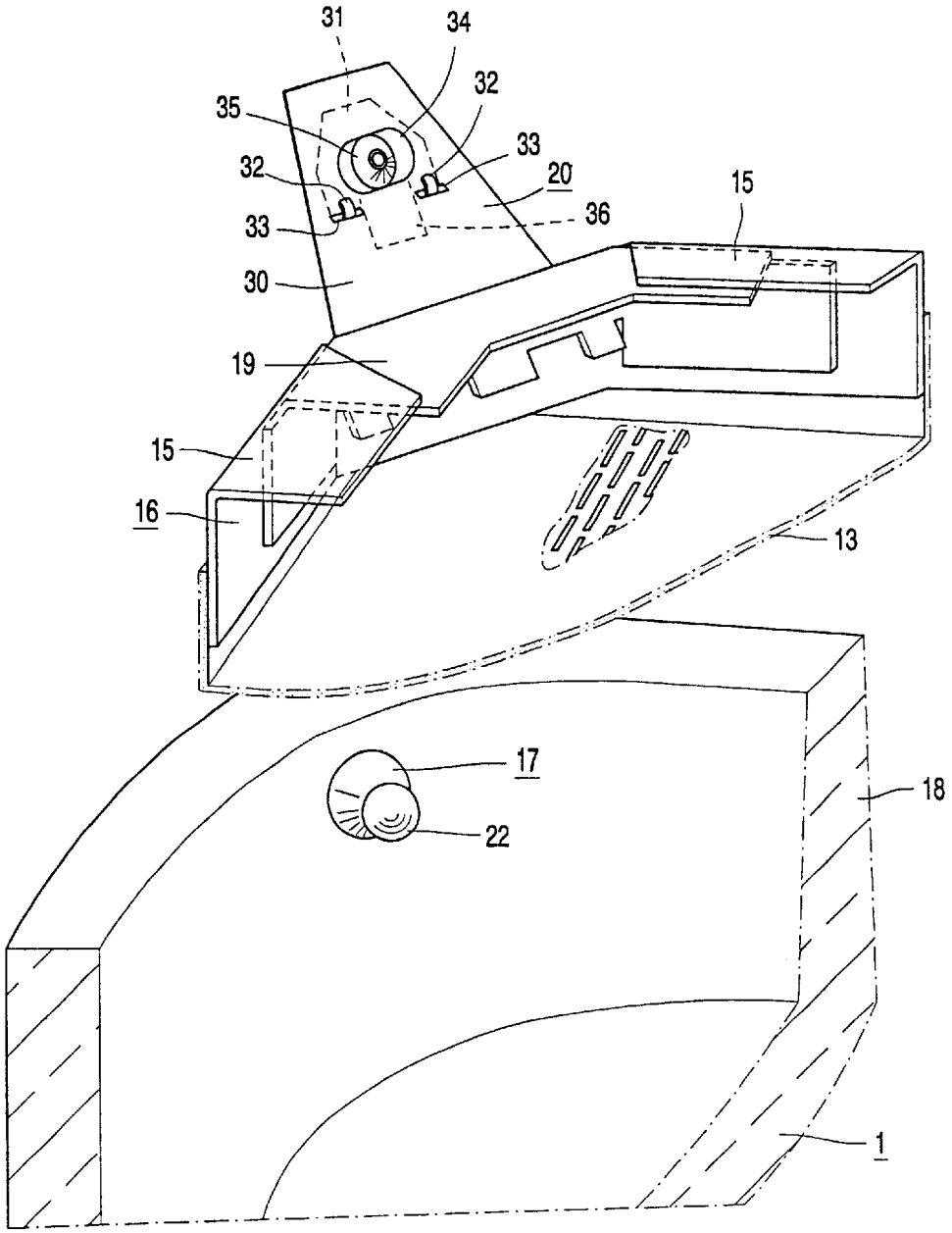
FIG. 6 is a perspective view of the corner area of the display window and the corner section of the color selection electrode.

FIGS. 5 and 6 show—in sectional and perspective view, respectively—the corner section 16 of the color selection electrode 12 according to the prior art, as well as the supporting element 22 in the display window 3. The corner section 16 comprises a rigid portion 19 to which the diaphragm parts 15 and a suspension element 20 are connected. This suspension element 20 comprises, among others, the following parts. The resilient element 30 is connected to the rigid portion 19 and has a slotted aperture 34. Mounted behind this slotted aperture 34 is a slide plate 31, for instance, by means of two bent tags 32 that protrude through apertures 33 in the resilient element 30. This slide plate 31 comprises a conical section 35 for engaging the more or less spherical free end portion 22 of the supporting element 17. After the color selection electrode 12 has been inserted into the display window for the first time, the slide plate 31 is rigidly secured to the resilient element 30, which may be done by welding the supporting member 36 to the resilient element 14.

Figure 7:
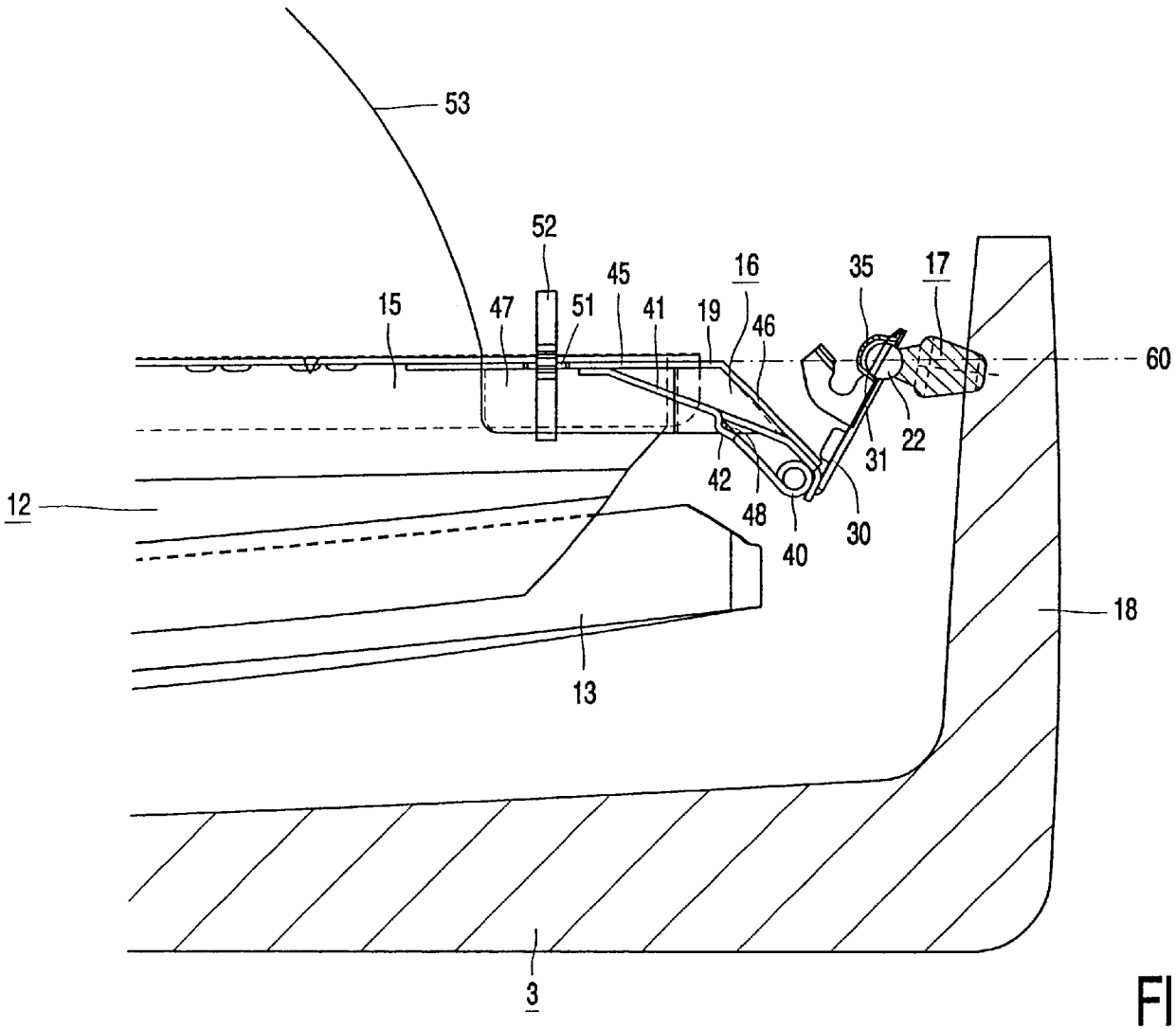
FIG. 7 is a cross-section of a portion of a tube of FIG. 1, showing the corner section of the color selection electrode according to the invention.
Figure 8:
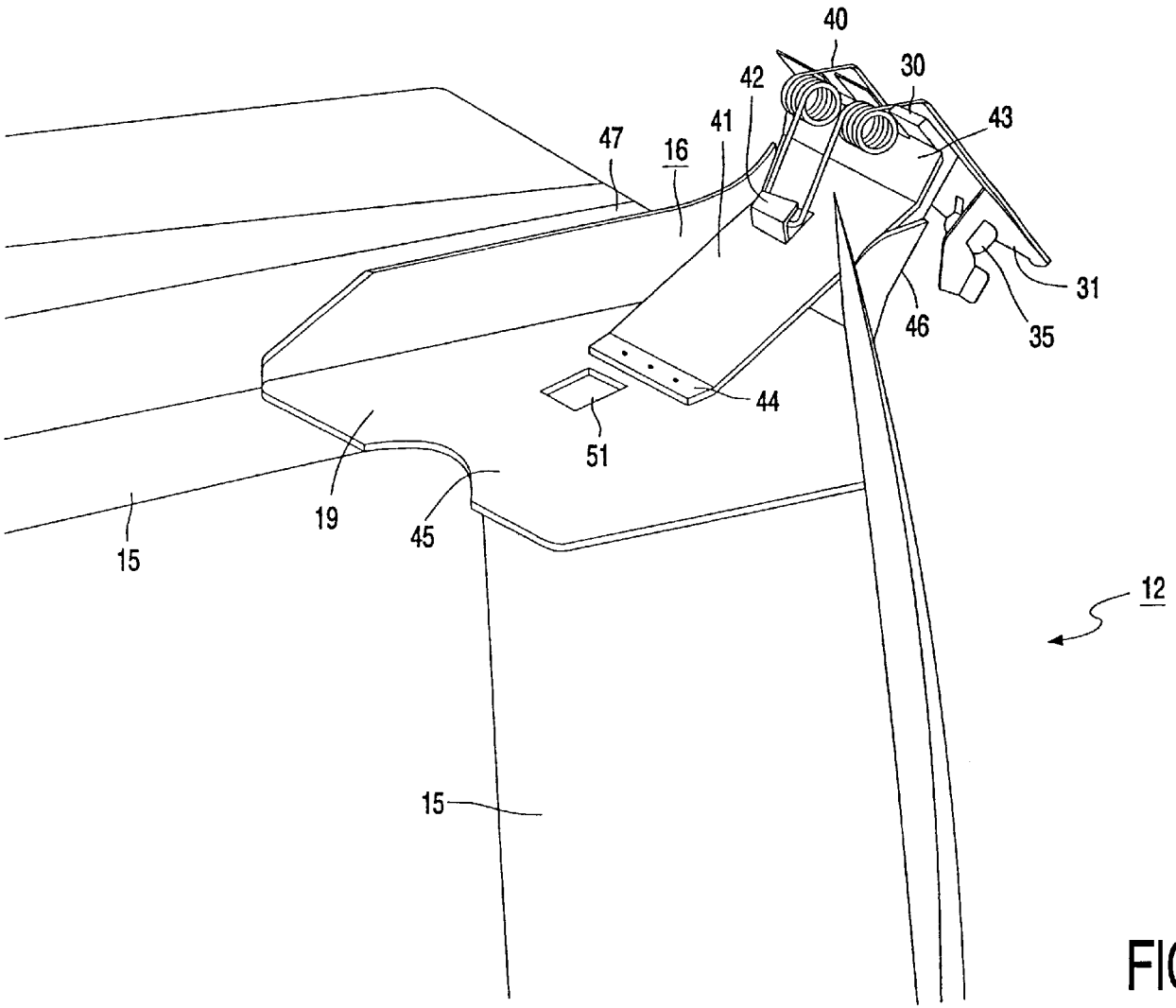
FIG. 8 is a perspective view of the corner section and the adjacent diaphragm parts of the color selection electrode according to the invention.
Figure 9:
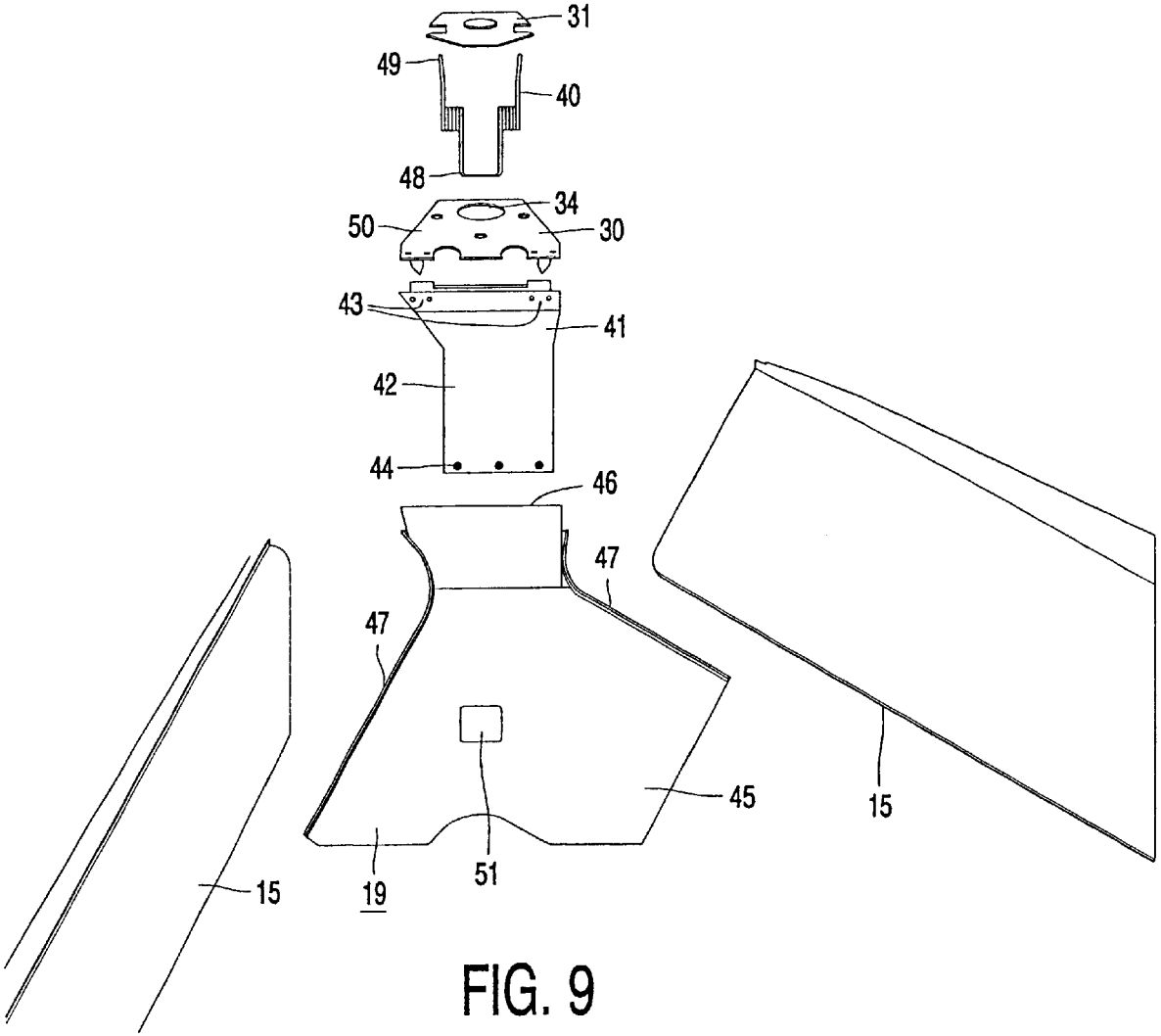
FIG. 9 is an exploded and perspective view of the corner section and the adjacent diaphragm parts of the color selection electrode according to the invention.

FIG. 7 shows the preferred embodiment of the invention, in which an additional support plate 41 increases the stiffness of the suspension element 20. FIGS. 8 and 9 are perspective and exploded views, respectively, of the corner section 16 of the color selection electrode 12 according to invention. Besides the main plate 45 of the rigid portion 19, the main plate 45 has two upright edges 47—for further increasing the stiffness—and an oblique surface 46. Now, the additional support plate 41 is mounted on the rigid portion 19 between the main plate 45 and the oblique surface 46, thereby increasing the stiffness of the suspension element 20. The support plate 41 can be mounted, for instance, by welding to the main plate 45 and the oblique surface 46 at the positions indicated by 44 and 43, respectively. The stiffness is increased by this measure, because, the corner section 16 is less easily deformed when a force acts parallel to the main plate 45 of the rigid portion 19. In FIG. 7, the resilient element 30 has been provided with a wire-wound spring 40 in order to make sure that the color selection electrode 12 is mounted in the display window 3 with a force that guarantees a reliable connection between the color selection electrode 12 and the supporting elements 17. One end of the spring 48 is held in place by a lug 42 that has been cut in the additional support plate 41, the other end 49 protrudes through apertures 50 in the resilient element 30 to simultaneously hold the shift plate 31. This is best seen in the exploded view in FIG. 9.

A second way of improving the stiffness of the color selection electrode 12 is based on the fact that it is advantageous when the free end portion 22 of the supporting element 17 is substantially in the plane that coincides with the main plate 45 of the rigid portion 19. In FIG. 7, this plane is denoted by the numeral 60. In the case of, for instance, a shock on the color display tube 1, which may cause a shift of the color selection electrode 12, it will be much more difficult to shift the color selection electrode 12 in the direction of the plane 60. In the prior art situation, shown in FIG. 5, a shock, especially in E/W direction, on the color display tube 1 will cause elastic deformations in the frame 14 of the color selection electrode 12. This introduces torsion of the resilient element 30 on the supporting elements 17, resulting in a degradation of the positional accuracy of the color selection electrode 12. After the shock, the color selection electrode 12 may end up in a shifted position more easily.If the centre of the free end 22 is in the plane passing through the rigid portion 19 of the corner section 16, the stiffness is thus increased.

An even further improvement in stiffness can be achieved when the corner section 16 is provided with an upright edge 47 and when the free end portion 22 is located in the plane that coincides with the upright edge 47. In this case, the color selection electrode 12 will be less deformed as a result of a shock, because the torsion between the resilient elements 20 and the supporting elements 17 is decreased.

The best situation can be achieved by designing a corner section 16 in such a way that the free end portion 22 is substantially at the intersection of the plane through the main plate 45 and the planes through the upright edges 47.

The options for manufacturing a color display tube with improved behavior on positional stability of the color selection electrode 12 render the results given in Table 1. In this Table, measurements on an existing 32" wide screen tube with a super flat display window are compared with a 32" wide screen tube with improved hysteresis and a real flat display window.

TABLE 1

| | | 32" Wide Screen Super Flat PRIOR ART | 32" Wide Screen Real Flat INVENTION |
|---|---|---|---|
| Hysteresis | H ($\mu$m) | 95 | 9 |
| Friction | W (N) | 7.5 | 2.5 |
| Stiffness | C (N/mm) | 66 | 208 |

It appears from this table that the measures described in this document will improve the stiffness of the color selection electrode by a factor of about 3. If also the improvement in friction is taken into account, the hysteresis is improved by a factor of about 10. Note that the hysteresis figures mentioned in this Table are in fact the real shift of a color selection electrode that may occur in a normal production process.

It will be clear to a person skilled in the art that this invention is not limited to the examples given here. Alternative measures for increasing the stiffness of the color selection electrode 12 and more particularly of the corner section 16 will achieve the same objective. For instance, it may be possible to make a one-part piece comprising the rigid portion 19 and the support plate 41. Moreover, the invention is not limited to a color selection electrode 12 having a corner suspension system comprising corner sections 16 and diaphragm parts 15. The invention is, for instance, also applicable to a corner suspension system comprising a ring-shaped frame with suspension elements coupled to this frame.

Figure 10:
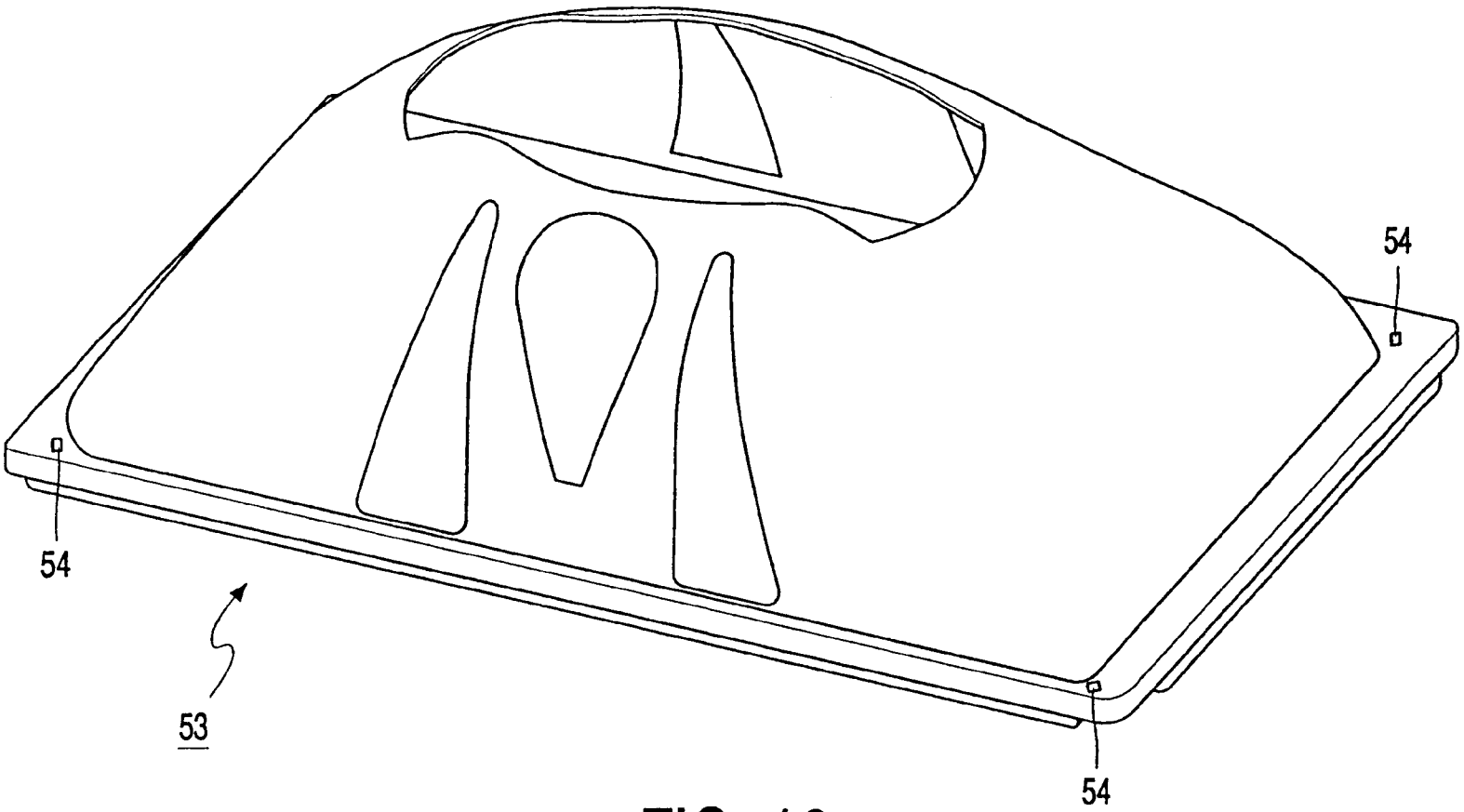
FIG. 10 is an inner magnetic shielding suitable for direct mounting.

An additional advantage of a color selection electrode 12 with an increased stiffness as described in this disclosure is found in the way the internal magnetic shielding can be mounted on the color selection electrode 12. The magnetic shielding quality in a color display tube can be improved by having the internal magnetic shielding as close to the diaphragm parts 15 of the color selection electrode 12 as possible, preferably without a gap between them. This improvement can be achieved in a color selection electrode 12 with increased stiffness by using the construction that was disclosed the Dutch patent application NL 8800424. In this application, a magnetic shielding is described that is connected by means of a number of clamping springs to corner sections of a color selection electrode. FIG. 10 shows an example of such a magnetic shielding 53. It is provided with apertures 54 that correspond to the apertures 51 of the corner sections 16 of the color selection electrode 12. By using clamping springs 52 (see FIG. 7), the internal magnetic shielding can easily be mounted on the color selection electrode 12.

In summary, a color display tube 1 is disclosed with an improved suspension of the color selection electrode 12. In order to have a color display tube with good properties of, for instance, color purity, it is of eminent importance that the positional stability of the color selection electrode 12 is excellent. Especially wide-screen tubes seem to be more sensitive to shocks by which the color selection electrode 12 may shift and cause discolorations. The positional stability of the color selection electrode 12 can be improved by increasing the stiffness of the corner sections 16 of the color selection electrode 12. This can be realized by introducing an additional support plate 41 in the corner section 16. Also the optimization of the position of the supporting element 17 with respect to this corner section 16 yields an improvement.

What is claimed is:

1. A color display tube (1) comprising a display window (3) with a circumferential upright edge and corner areas (18), a color selection electrode (12) having a frame (14) comprising corner sections (16) having a rigid portion (19), which color selection electrode (12) is suspended from supporting elements (17) secured to the corner areas (18), with suspension means (20) coupled to the corner sections (16), characterized in that each rigid portion (19) is provided with a part, fixed onto the rigid portion (19), increasing the stiffness of the corner section (16).

2. A color display tube (1) as claimed in claim 1, characterized in that the rigid portion (19) comprises a main plate (45) and an oblique surface (46), and the part for increasing the stiffness comprises an additional support plate (41) interconnecting the main plate (45) and the oblique surface (46).

3. A color display tube (1) as claimed in claim 1, characterized in that the stiffness is further increased by having free end portions (22) of the supporting elements (17) substantially located in a plane (60) which coincides with the main plates (45) of the rigid portions (19) of the corner sections (16).

4. A color display tube (1) as claimed in claim 1, characterized in that the rigid portions (19) of the corner sections (16) are provided with an upright edge (47).

5. A color display tube (1) as claimed in claim 4, characterized in that the stiffness is further increased by having free end portions (22) of the supporting elements (17) substantially located in a plane which coincides with the upright edge (47) of the rigid portions (19) of the corner sections (16).

6. A corner section (16) for use in a color selection electrode (12) of a color display tube (1), having a rigid portion (19) and suspension means (20), characterized in that the rigid portion (19) is provided with a part, fixed onto the rigid portion (19), increasing the stiffness of the corner section (16).

7. A corner section (16) as claimed in claim 6, characterized in that the rigid portion (19) comprises a main plate (45) and an oblique surface (46), and the part for increasing the stiffness comprises an additional support plate (41) interconnecting the main plate (45) and the oblique surface (46).

8. A corner section (16) as claimed in claim 6, characterized in that the suspension means (20) comprises means (31,35) for coupling it to the supporting element (17) secured to the corner areas (18) of the display window (3), and the rigid portion (19) comprises a main plate (45), such that the stiffness is further increased by having the means (31,35) substantially located in a plane (60) which coincides with the main plate (45) of the rigid portion (19) of the corner section (16).

9. A corner section (16) as claimed in claim 6, characterized in that the rigid portion (19) is provided with an upright edge (47).

10. A corner section (16) as claimed in claim 9, characterized in that the suspension means (20) comprises means (31,35) for coupling it to the supporting element (17) secured to the corner areas (18) of the display window (3), such that the stiffness is further increased by having the means (31,35) substantially located in a plane which coincides with the upright edge (47) of the rigid portions (19) of the corner sections (16).

11. A color selection electrode (12) provided with the corner section (16) as claimed in claim 6.

* * * * *